US009708034B2

(12) United States Patent
Stier

(10) Patent No.: US 9,708,034 B2
(45) Date of Patent: Jul. 18, 2017

(54) COVER SYSTEM FOR PONTOON BOATS

(71) Applicant: Paul Stier, Rosemount, MN (US)

(72) Inventor: Paul Stier, Rosemount, MN (US)

( * ) Notice: Subject to any disclaimer, the term of this patent is extended or adjusted under 35 U.S.C. 154(b) by 0 days.

(21) Appl. No.: 15/299,744

(22) Filed: Oct. 21, 2016

(65) Prior Publication Data

US 2017/0152006 A1 Jun. 1, 2017

Related U.S. Application Data

(60) Provisional application No. 62/261,429, filed on Dec. 1, 2015.

(51) Int. Cl.
*B63B 17/02* (2006.01)

(52) U.S. Cl.
CPC ..... *B63B 17/02* (2013.01)

(58) Field of Classification Search
CPC ..... B63B 17/02
See application file for complete search history.

(56) References Cited

U.S. PATENT DOCUMENTS 4,641,600 A 2/1987 Halvorsen
4,657,062 A 4/1987 Tuerk
6,478,361 B1 11/2002 Wood
6,978,732 B1 * 12/2005 Jirak ..... B63B 17/02 114/361
7,249,568 B1 * 7/2007 Cultrara ..... B63B 35/732 114/361
7,455,027 B1 11/2008 Dickerson
7,484,472 B1 * 2/2009 Highfield ..... B63B 17/02 114/361
8,496,283 B1 7/2013 Schmeichel et al.

* cited by examiner

*Primary Examiner* — Edwin Swinehart
(74) *Attorney, Agent, or Firm* — Global Intellectual Property Agency, LLC; Daniel Boudwin

(57) ABSTRACT

A cover system for pontoon boats is provided. The cover system facilitates the expeditious covering of a pontoon boat. The cover system includes a plurality of support bows that are laterally extendable across a pontoon boat deck and attachable to the railing of a superstructure thereof. A cover is affixed to a tubular roller that is configured to extend and retract the cover over the plurality of support bows. Support arms disposed at ends of the tubular roller include brackets for mounting the tubular roller onto the superstructure of a pontoon boat and supporting the cover on a side thereof. A handle is attached to the cover for enabling a user to manually extend the cover over the plurality of support bows. The tubular roller is operably coupled to an actuator that is configured to rotate the roller and retract the cover.

20 Claims, 9 Drawing Sheets

COVER SYSTEM FOR PONTOON BOATS

CROSS REFERENCE TO RELATED APPLICATIONS

This application claims the benefit of U.S. Provisional Application No. 62/261,429 filed on Dec. 1, 2015. The above identified patent application is herein incorporated by reference in its entirety to provide continuity of disclosure.

BACKGROUND OF THE INVENTION

The present invention relates to pontoon boat covers. More specifically, the present invention relates to a cover system for pontoon boats including a cover configured to extend and retract over a plurality of support bows to efficiently cover a pontoon boat.

The majority of existing pontoon boat covers require laborious work to install and remove. For instance, conventional pontoon boat covers need to be pulled over the entirety of a pontoon boat as well as snapped around the entire perimeter of the pontoon boat in order to be properly secured. Moreover, the covers require that a user insert various support poles that vertically extend from the floor of the pontoon boat after the cover has been secured, which requires the user to crawl under the cover to insert them as needed. Furthermore, these covers are bulky, heavy, and take up a great deal of space, thus making them difficult to store when not in use. As a result, conventional covers take away from the enjoyment of using pontoon boats, particularly because the work involved in installing them deters users from taking their pontoon boats out when the chance of precipitation is even the slightest. Thus, there is a need for a cover system for pontoon boats that provides a quick and convenient way to cover and uncover a pontoon boat for immediate use or protection from inclement weather.

The use of pontoon boat covers for efficiently covering a pontoon boat are known in the art. More specifically, pontoon boat covers including covers for covering a pontoon boat to shield the pontoon from the elements heretofore devised and utilized are known to consist basically of familiar, expected, and obvious structural configurations, notwithstanding the myriad of designs encompassed by the crowded prior art which have been developed for the fulfillment of countless objectives and requirements.

In these respects, the cover system for pontoon boats according to the present invention substantially departs from the conventional concepts and designs of the prior art and in so doing provides a system primarily developed for the purpose of providing a cover affixed to a pontoon boat that is configured to expeditiously cover the pontoon boat without much difficulty.

SUMMARY OF THE INVENTION

In view of the foregoing disadvantages inherent in the known types of pontoon boat covers now present in the prior art, the present invention provides a cover system for pontoon boats wherein the same can be utilized for providing convenience for the user when uncovering and covering his or her pontoon boat. The cover system includes: a plurality of arcuate support bows including a distal member and a proximal member configured to attach to a superstructure of a pontoon boat; a fastener disposed on an end of the distal member; a plurality of tubular members, each of the plurality of tubular members slidably housing one of the plurality of arcuate support bows, wherein each of the plurality of arcuate support bows is configured to slidably extend and retract from the tubular member; a roller including a first end and a second end, the first end and the second end including a support arm having a bracket for mounting the roller to the superstructure of a pontoon boat; a tarpaulin cover including a first end and a free second end, the first end being attached to the roller and the free second end including a handle and a plurality of fasteners, wherein the roller is configured to extend and retract the cover; and an actuator operably coupled to the roller, the actuator configured to retract the cover via rotation of the roller.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
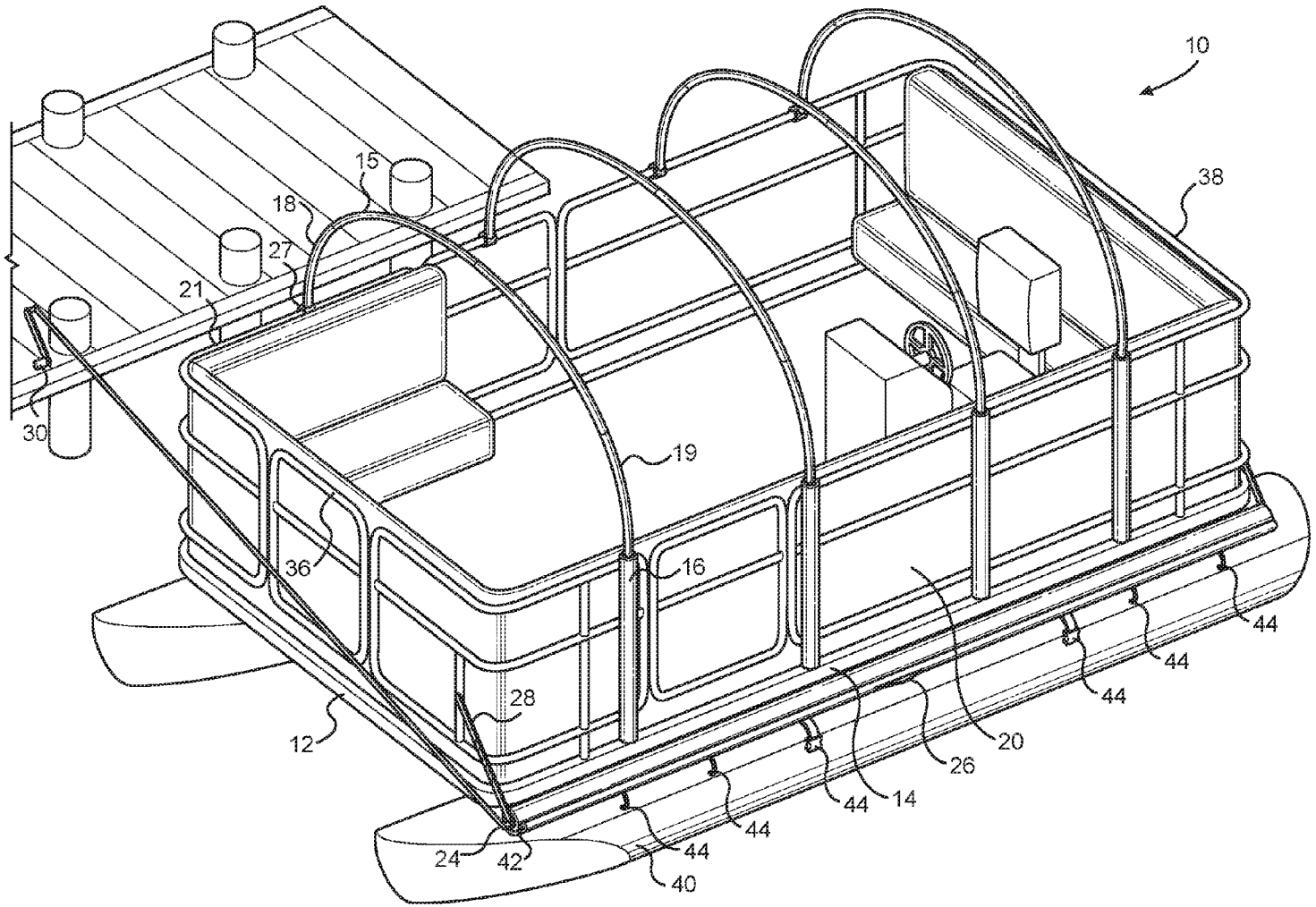
FIG. 1 shows a perspective view of the cover system as attached to a conventional pontoon boat in a retracted position.

Reference is made herein to the attached drawings. Like reference numerals are used throughout the drawings to depict like or similar elements of the cover system for pontoon boats. The figures are intended for representative purposes only and should not be considered to be limiting in any respect.

The present invention provides a cover system for a pontoon boat that is attachable to the superstructure of a pontoon boat. FIGS. 1-9 illustrate the cover system 10 as attached to a conventional pontoon boat 12. The cover system 10 comprises a plurality of arcuate support bows 15, which are laterally extendable across a pontoon boat deck 14 and attachable to the superstructure 20 of the pontoon boat 12, and a cover 22 attached to a tubular roller 24 that is configured to extend and retract the cover 22 over the plurality of support bows 15. A handle 26 may be attached to the cover 22 for enabling a user to manually extend the cover 22 over the plurality of support bows 15 in a first direction. Support arms 28 disposed at ends of the elongated roller 24 are attachable to the superstructure 20 of the pontoon boat 12. The support arms 28 support the cover 22 on the side of the pontoon boat 12. The elongated roller 24 is operably coupled to an actuator 30 that is configured to rotate the roller 24 in a second direction to retract the cover 22.

Figure 6:
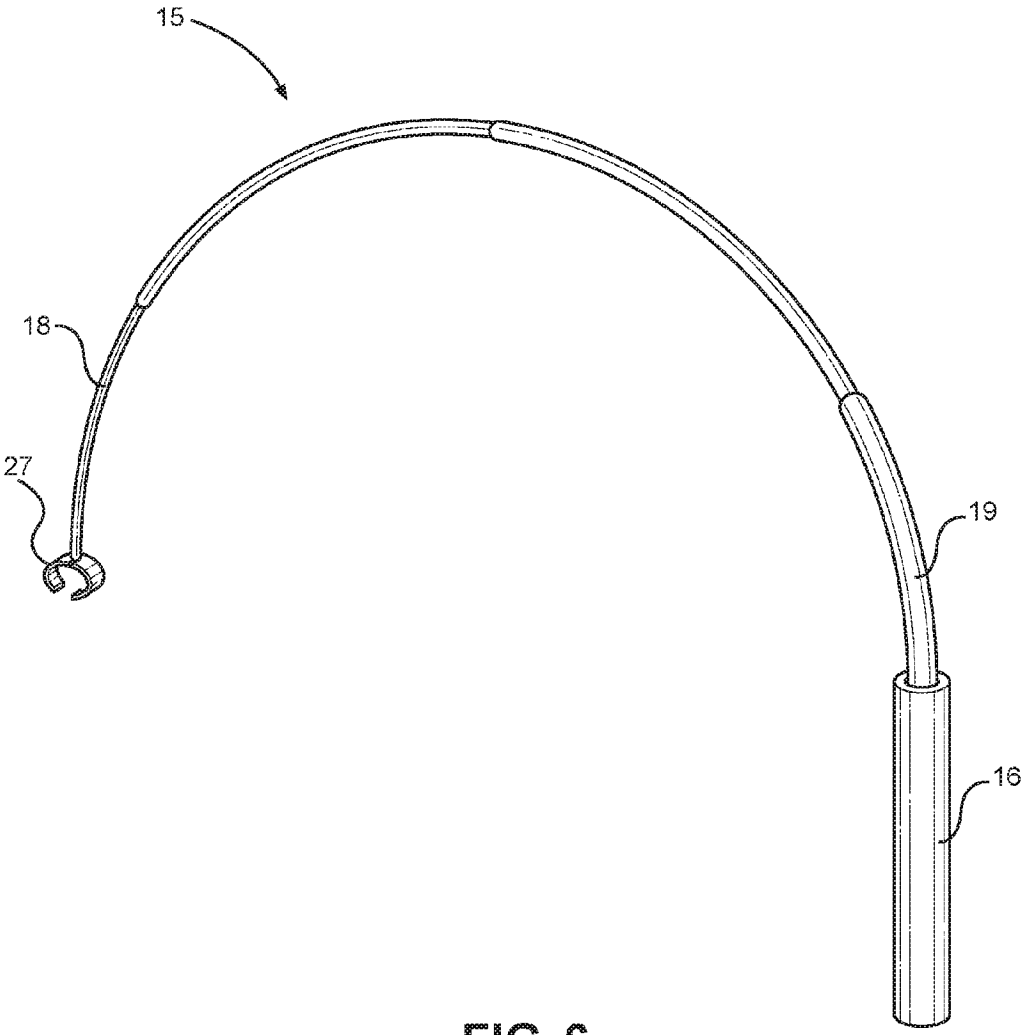
FIG. 6 shows a close-up view of a tubular member and a support bow telescoping therefrom.

Each of the plurality of arcuate support bows 15 includes a plurality of elongated members 17 that are slidably disposed within one another, forming a telescopic arrangement. The elongated members 17 are constructed of a flexible material such as plastic. The cover system 10 further includes tubular members 16 that are configured to house the arcuate support bows 15 and enable them to be retracted and extended therefrom, as shown by FIGS. 1 and 6. One of the elongated members 17 of each of the support bows 15 includes a distal elongated member 18 including an end having a fastener 27 disposed thereon and a proximal elongated member 19 slidably disposed in the tubular member 16, as shown by FIG. 6. The fastener 27 of the distal member 18 is configured to attach to the gate side railing 21 of the pontoon boat superstructure 20. In one embodiment, the fastener 27 includes a clamp configured to clasp the gate side railing 21. In another embodiment, the fastener 27 includes a mounting bracket configured to receive the non-docking side railing 23. The telescopic arrangement enables the elongated members 17 to telescope from the tubular members 16 such that they can be extended for use, adjusted to accommodate differently sized pontoon boats, and retracted for storage. In this way, the tubular housing 16 also provides a storage structure for the support bows 15.

The tubular members 16 are configured to be mounted onto a side of the pontoon boat superstructure 20, such that the support bows 15 can extend laterally across the pontoon boat deck 14 from the tubular members 16. In one embodiment, the tubular members 16 are fixedly mounted onto the non-docking side (i.e., the side opposite the gate side) of the pontoon boat superstructure 20 inward from the front and rear of the boat 12 and evenly spaced apart, as shown in FIGS. 1-5. In another embodiment, the tubular members 16 include a mounting bracket for removably mounting the tubular members 16 onto the superstructure 20.

In the depicted embodiments, the pontoon boat 12 includes four support bows 15 to provide adequate support for the cover 22 when extended thereover. When extended from the tubular housing 16 and attached to the superstructure 20, the support bows 15 form an arch having a height that extends above the highest portions of the pontoon boat 12. The length of the support bows 15 varies depending on the width of a pontoon boat 12.

Figure 7:
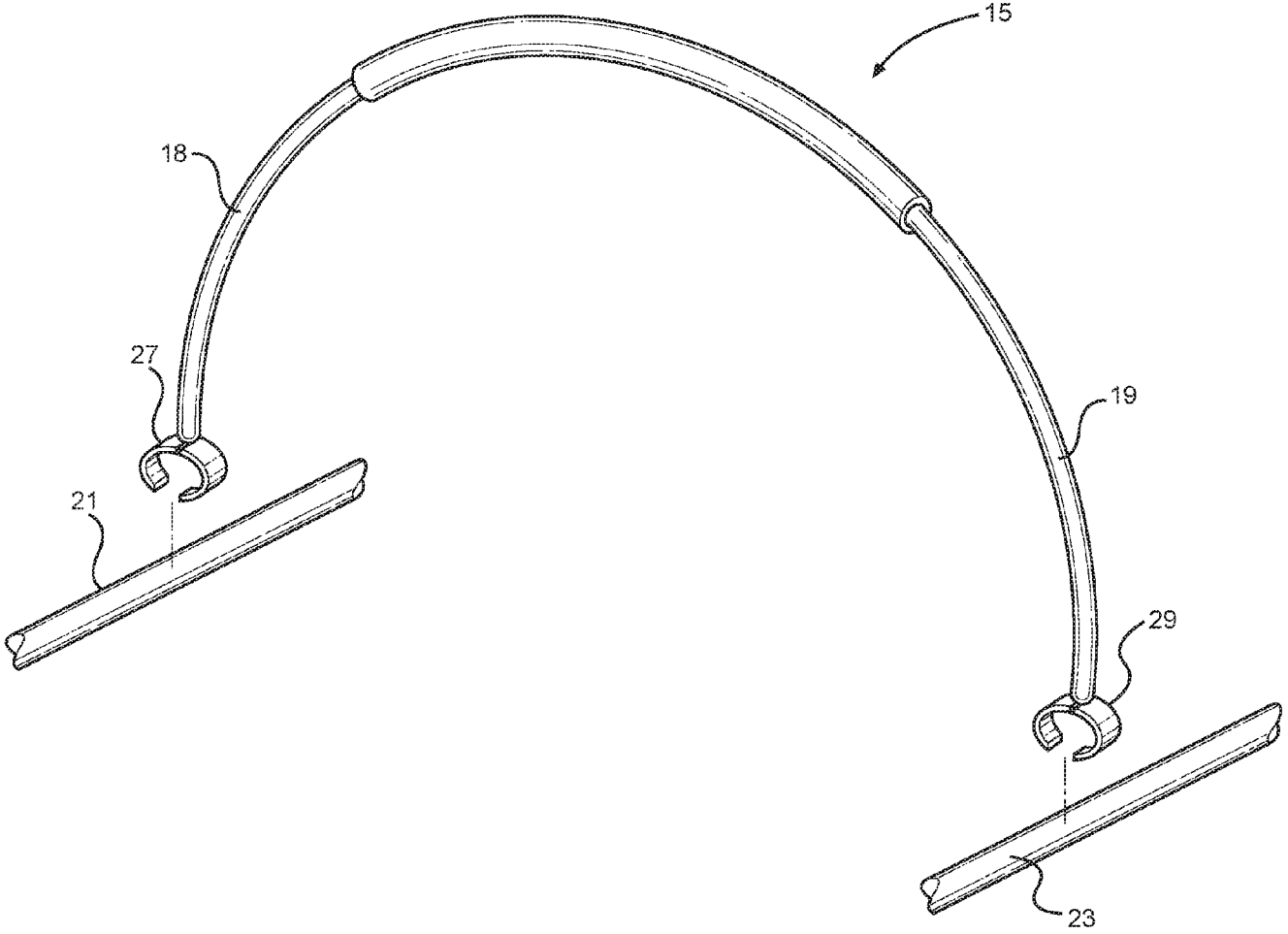
FIG. 7 shows an exploded view of a support bow of the cover system.
Figure 8:
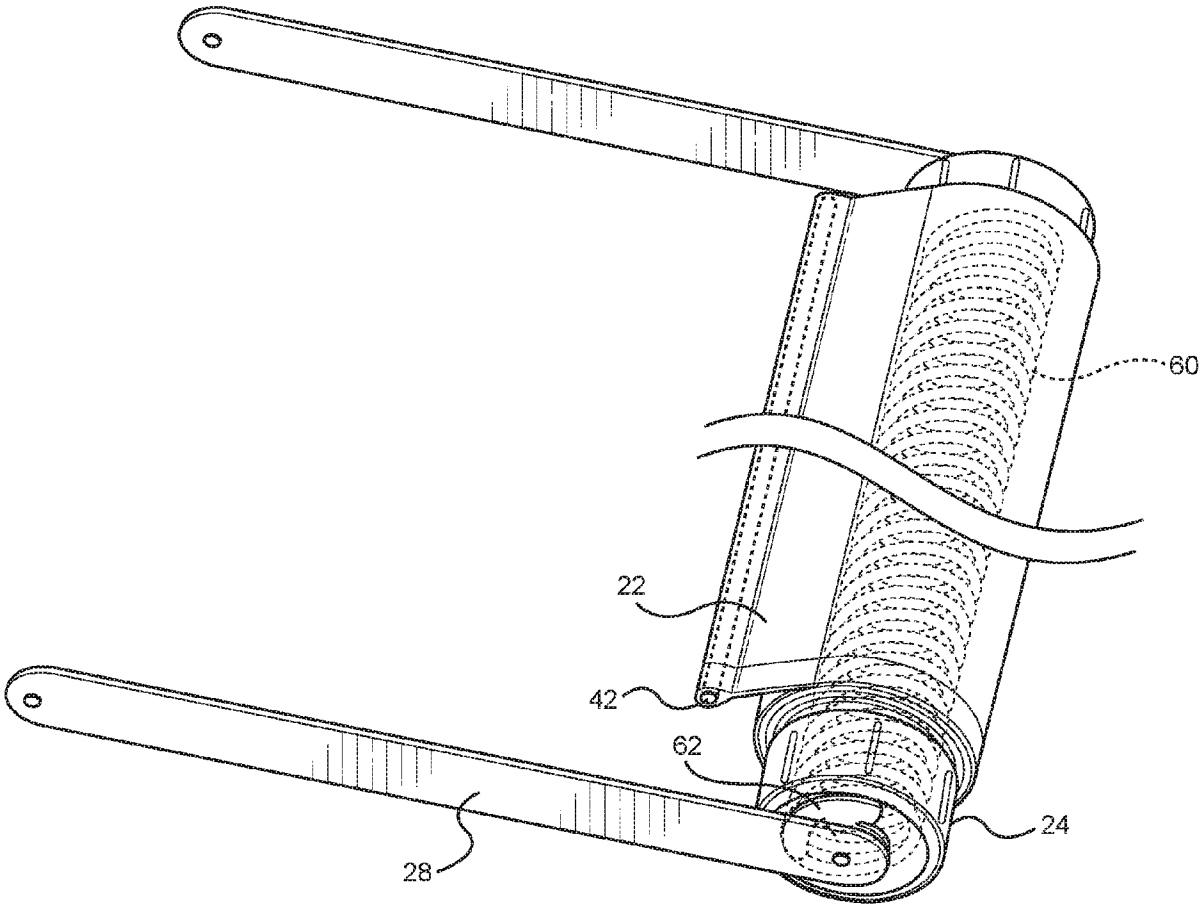
FIG. 8 shows a perspective phantom view of the spring-biased actuator of the cover system.

In an alternative embodiment, each of the support bows 15 includes a second fastener 29 disposed on the proximal member 19 that is configured to attach to a non-docking side railing 23 of the superstructure 20 as shown in FIGS. 7 and 8. In one embodiment, the second fastener 29 includes a clamp configured to clasp the non-docking side railing 23. In another embodiment, the fastener 29 includes a mounting bracket configured to receive the non-docking side railing 23.

The tubular roller 24 includes an elongated cylindrical structure, such as a cylindrical tube, that is affixed to the side of the pontoon boat 12 as shown in FIGS. 1-5. The tubular roller 24 extends along the longitudinal length of the pontoon boat 12 from the front (bow) to the back (stern) of the pontoon boat 12. In one embodiment, the roller 24 has a length that is approximately equal to or greater than the length of the pontoon boat deck 14.

The support arms 28 are attachable to the front railing 36 and the rear railing 38 of the superstructure 20 of the pontoon boat 12. The support arms 28 extend parallel to front and rear railing 36, 38 toward and past the opposing side railing 23 (or non-docking side railing) of the superstructure 20, such that the support arms 28 protrude therefrom. In one embodiment, the support arms 28 are fixedly connected to the front and rear railings 36, 38 of the superstructure 20 and angled downwardly relative to the pontoon boat 12 to maintain the roller 24 positioned between the pontoon boat deck 14 and a pontoon 40 of the pontoon boat 12. In another embodiment, the support arms 28 are pivotally connected to the front and rear railings 36, 38 of the superstructure 20, and movable upwards and downwards relative to the pontoon boat 12, such that the elongated roller 24 can be positionable between a stowed position, wherein the roller 24 rests between the pontoon boat deck 14 and the pontoon 40, and a deployment position, wherein the roller 24 rests adjacent to the non-docking side railing 23. In this way, the elongated roller 24 may be moved into a stowed position when not in use and a deployment position when extending the cover 22 over the support bows 15. In one embodiment, the support arms 28 include brackets for mounting the support arms 28 to the pontoon boat superstructure 20.

In one embodiment, the actuator 22 of the roller 24 includes a spring-biased actuator disposed in an interior volume thereof that includes a biased spring 60 and a ratchet 62 as shown in FIG. 8. The spring 60 is biased towards the second direction and acquires more tension as the cover 22 is manually extended in the first direction over the support bows 15. The ratchet 62 enables a user to lock the cover 22 in an extended position and further release the tension of the spring 60. Releasing the tension of the spring 60 initiates rotation of the roller 24 in the second direction, which retracts and winds the cover 22 around the roller 24. In an alternative embodiment, the actuator 22 includes an elongated hand crank having a length greater than the width of the pontoon boat deck 12 and superstructure 20, as shown in FIG. 1, thereby enabling a user on a dock to actuate the hand crank when the pontoon boat is moored. Rotation of the hand crank in a clockwise direction rotates the roller 24 in the second direction, thereby retracting the cover 22. In another embodiment, the actuator 30 includes an electric motor that rotates the roller 24 in the second direction upon actuation of an activation switch disposed on the pontoon boat steering station, in one embodiment, or on a remote control, in an alternative embodiment.

Figure 2:
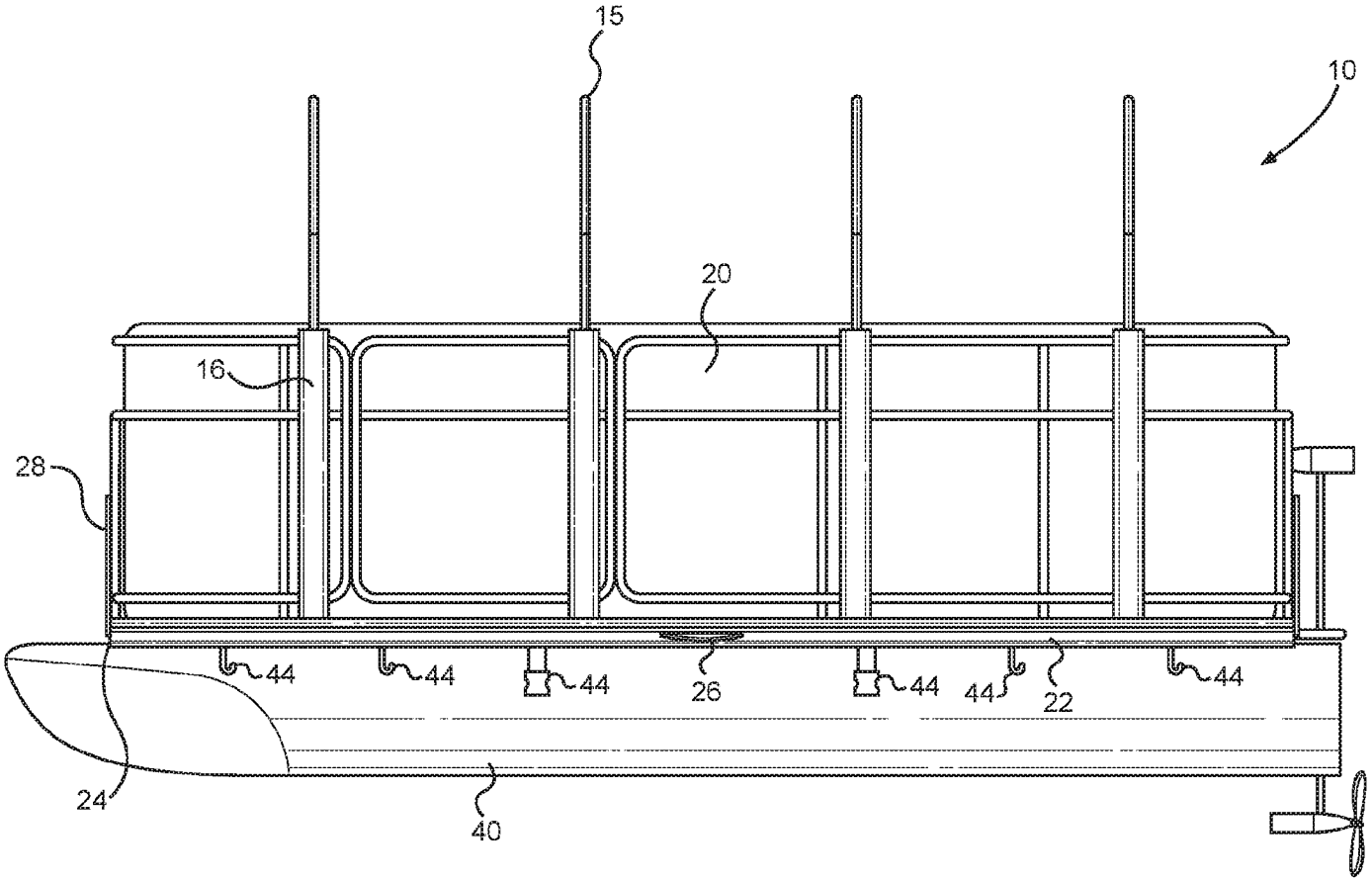
FIG. 2 shows a side view of the cover system as attached to a conventional pontoon boat in a retracted position.
Figure 4:
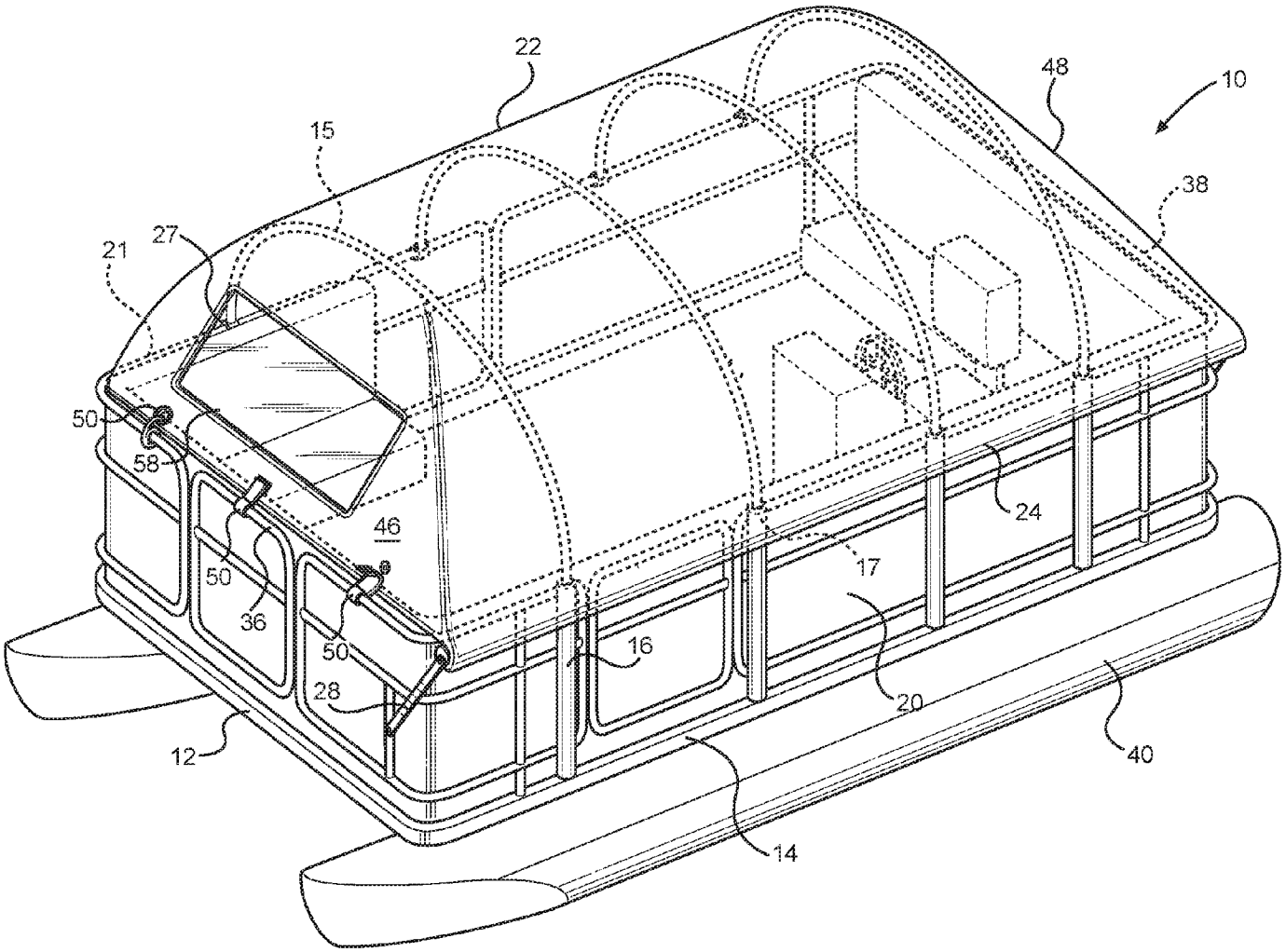
FIG. 4 shows a perspective view of the cover system as attached to a conventional pontoon boat in an extended position.
Figure 5:
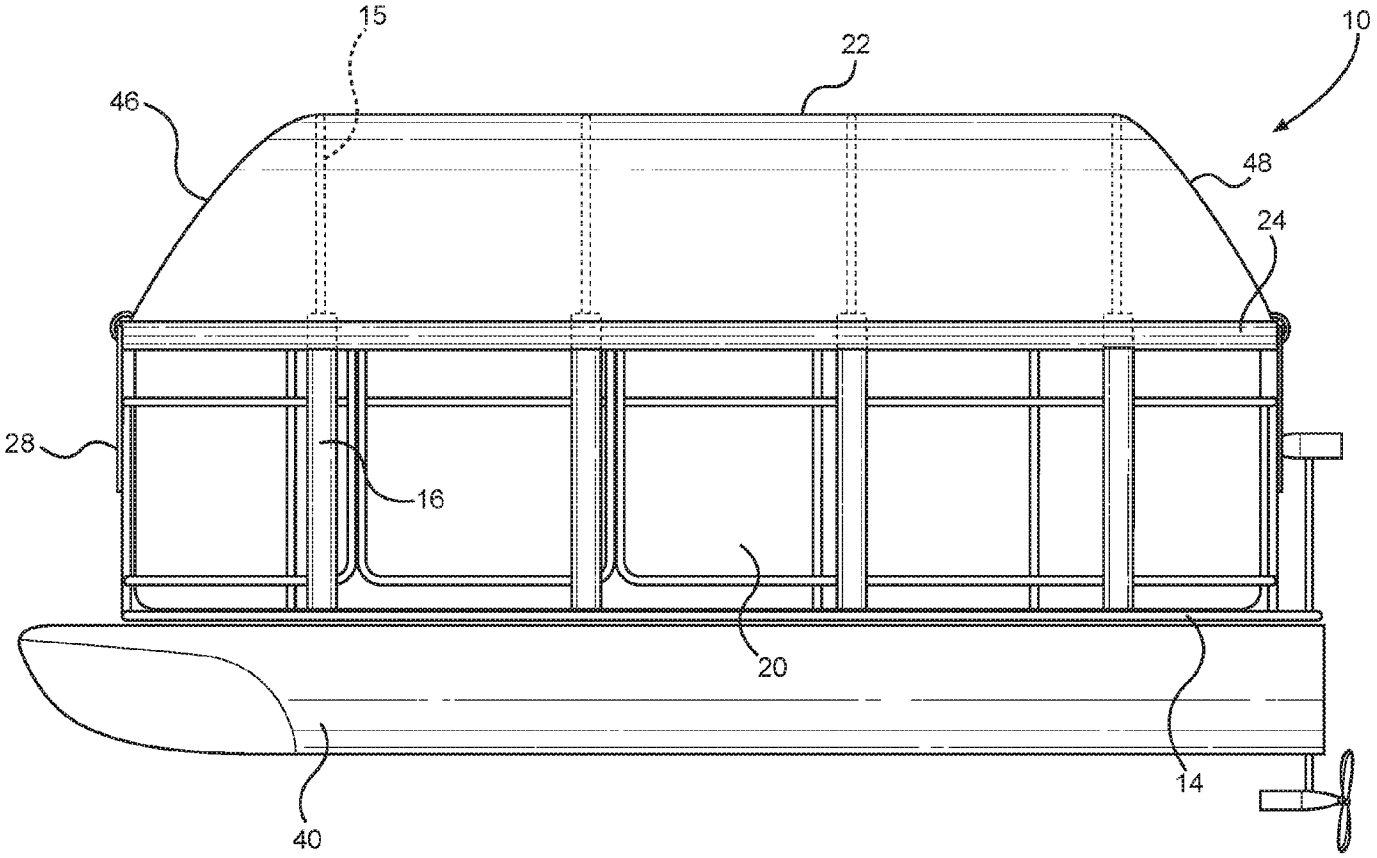
FIG. 5 shows a side view of the cover system as attached to a conventional pontoon boat in an extended position.

The cover 22 comprises an expansive structure configured to extend over the support bows 15 and cover the entire pontoon boat deck 14 and superstructure 20 as shown in FIGS. 4 and 5. In one embodiment, the cover 22 is constructed from a material including water impermeable tarpaulin. In other embodiments, the cover 22 may be constructed of other water impermeable materials, such as nylon, polyester, canvas, urethane, or polyethylene. The cover 22 includes a first end that is attached to the elongated roller 24 and a free second end that can be, e.g., gripped by a user via the handle 26 to extend the cover 22 from the roller 24. The cover 22 is positionable between a retracted position as shown in FIGS. 1 and 2, in which it is wound around the elongated roller 24, and an extended position as shown in FIGS. 4 and 5, in which is it extended over the support bows 15 and unwound from the elongated roller 24.

Figure 3:
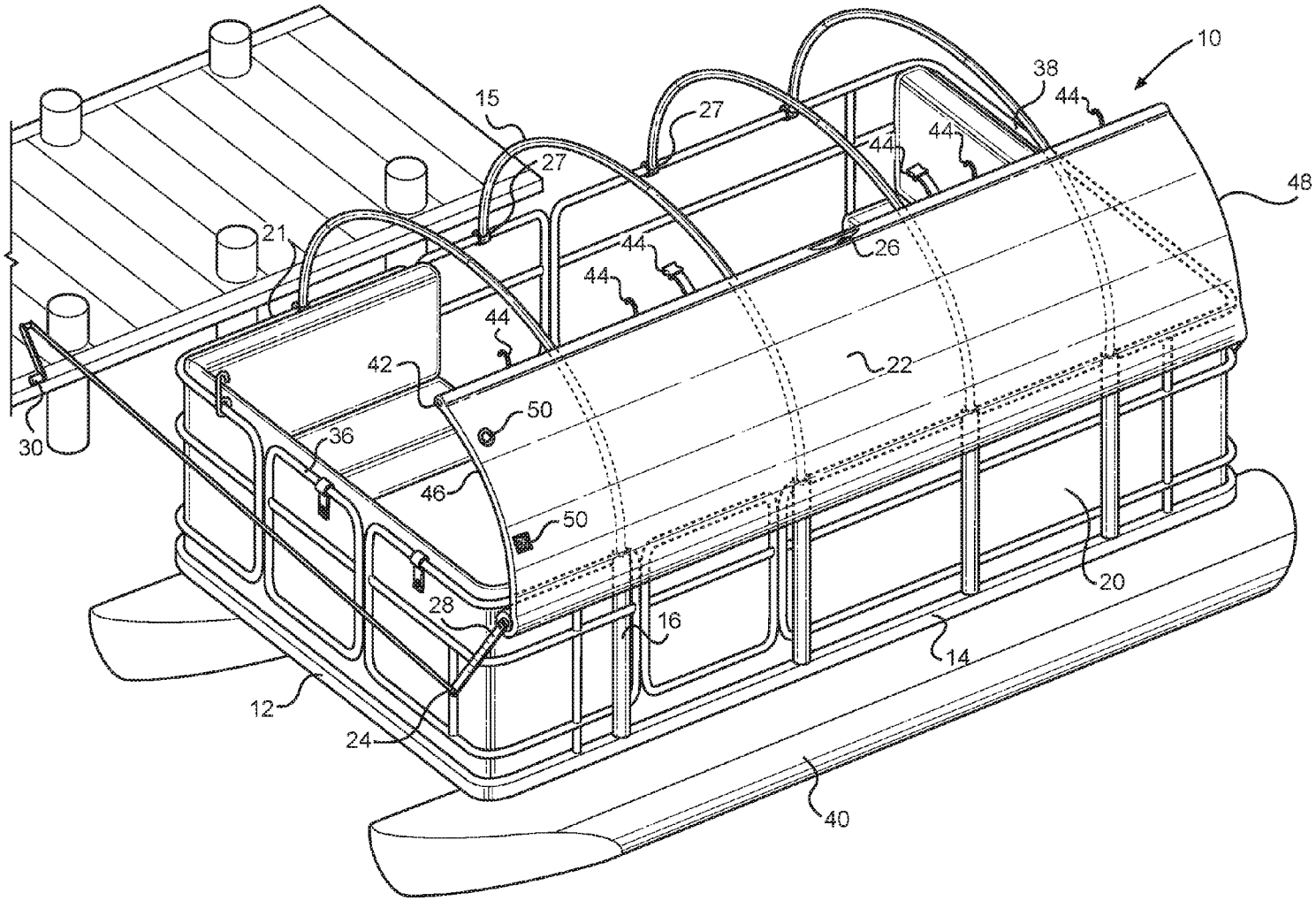
FIG. 3 shows a perspective view of the cover system as attached to a conventional pontoon boat in a partially retracted position.

The cover 22 includes a free second end having an elongated rod 42 that extends along its peripheral edge as shown in FIGS. 3 and 8. In one embodiment, the edge of the free second end is folded over the elongated rod 42 and fastened or sewn to the cover 22 to secure the elongated rod 42 therein. The cover 22 includes a plurality of fasteners 44 disposed along the free second end for securing the cover 22 in its extended position. In one embodiment, the fasteners 44 comprise clamps configured to clamp to the superstructure 20 of the pontoon boat 12. In another embodiment, the fasteners 44 comprise a plurality of hooks or tie downs.

The cover 22 further includes a first side 46 and a second side 48 that are attachable to the bow and stern of the pontoon boat 12. The sides 46, 48 each have a length configured to extend over the front and rear railings 36, 38 of the superstructure 20 as shown in FIGS. 4 and 5. In this way, the sides 46, 48 enable the cover 22 to fully enclose the interior of the pontoon boat superstructure 20 when extended over the support bows 15. The sides 46, 48 include a plurality of fasteners 50 that are securable to the front and rear end of the pontoon boat 12. The plurality of fasteners 50 comprise grommets configured to receive a hook, male or female portions of a hook and loop fastener, such as Velcro, which are configured to receive the corresponding male or female portion, or the male or female portion of a button snap, which is configured to receive corresponding male or female portion.

In one embodiment, the first side 46 includes a transparent portion 58, as shown in FIG. 4, which serves as a window and enables a user to see out of the front of the pontoon boat if and when a user must drive and navigate the pontoon boat when the cover 22 is extended thereover. In one embodiment, the transparent portion 58 is centrally disposed on the first side 46 and includes a rectangular shape; however, no restriction on the location and shape of the transparent portion 58 is intended.

Figure 9:
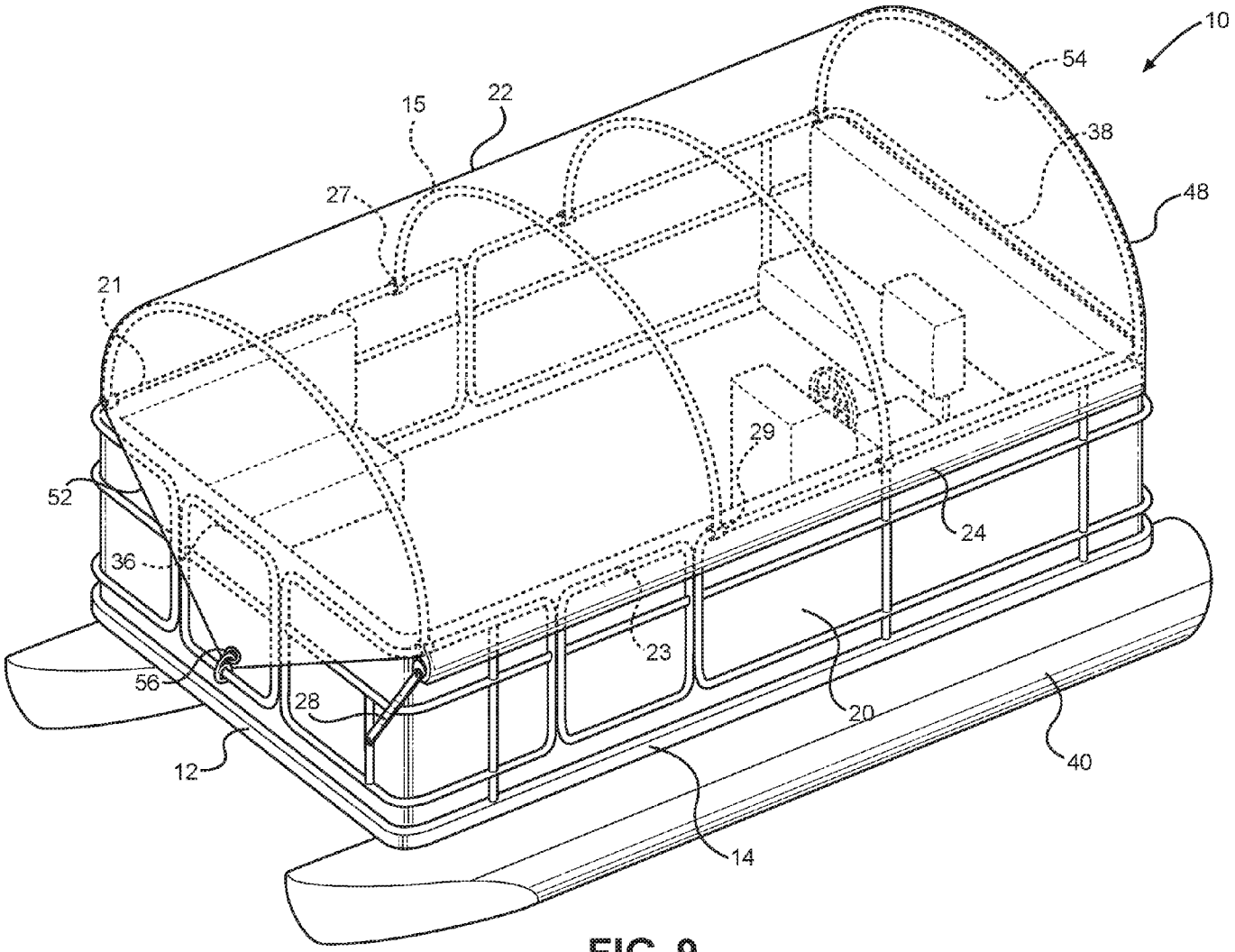
FIG. 9 shows a perspective view of the flaps of the cover system as attached to a conventional pontoon boat in an extended position.

In an alternative embodiment, the cover 22 includes a first flap 52 attached to an edge of the first side 46 of the cover 22 and a second flap 54 attached to an edge of the second side 48 of the cover 22 as shown in FIG. 9. The flaps 52, 54 are foldable about the edges of the sides 46, 48 of the cover 22 so that they may be folded about the edges of the sides 46, 48 of the cover 22 and wound around the elongated roller 24 along with the cover 22 when retracted. The flaps 52, 54 are made available during extension of the cover 22 over the pontoon boat 12 and are configured to further enclose the superstructure 20 and pontoon boat deck 14 of the pontoon boat 12. When the cover 22 is extended, the flaps 52, 54 fold radially outwardly from the sides 46, 48 of the cover 22. The flaps 52, 54 each have a length configured to extend over the front and rear railings 36, 38 of the superstructure 20 of the pontoon boat 12 and reaching the front and the rear thereof. The flaps 52, 54 each include one or more fasteners 56 at an end thereof for further securing the cover 22 in its extended position over the pontoon boat 12.

In use, the flaps 52, 54 would be employed by first extending the cover 22 over the support bows 15, attaching the cover 22 to the first railing 21 of the superstructure 20, unfolding the flaps 52, 54 radially outwardly relative to the cover 22, extending the flaps 52, 54 over the front and rear railings 36, 38 and then attaching the flaps 52, 54 to the front and rear of the pontoon boat 12 via the fasteners 56. When retracting the cover, the flaps 52, 54 would be stowed by first unfastening the flaps 46, 48 from the pontoon boat 12, folding the flaps 52, 54 radially inwardly onto the cover 22, detaching the cover 22 from the first railing 21, and retracting the cover 22 about the elongated roller 24.

In one operation of the cover system 10, a user extends all of the support bows 15 from the tubular housings 16 and attaches them to the gate side railing 21 of the pontoon boat superstructure 20, such that each forms an arch over the highest portions of the pontoon boat 12 as shown in FIG. 1. The user then positions the elongated roller 24 adjacent to the non-docking side railing 23 in its deployment position from its stowed position by pivoting the support arms 28 upwards as shown by FIG. 3. The user then extends the cover 22 from the elongated roller 24 in a first direction over the support bows 15 by manually using the handle 26 to pull the cover 22 over the support bows 15. The user then secures the free second end of the cover 22 to the gate side railing 21 by securing the plurality of fasteners 44 thereto. A user then extends the first and second sides 46, 48 of the cover 22 over the front and rear railings 36, 38 of the superstructure 20 and attaches the sides 46, 48 to the front and rear, respectively, via the fasteners 50 to fully enclose the pontoon boat superstructure 20 as shown in FIGS. 4 and 5. The support bows 15 support the cover 22 above the pontoon boat superstructure 20 and deck 14. After the cover 22 is fully fastened around the pontoon boat superstructure 20, a user may then utilize the actuator 30 to retract the cover 22 in the second direction about the roller 24 until it is sufficiently taunt upon the support bows 15. The cover 22 is tautly retained in its extended position via the fasteners 44. When a user wishes to retract the cover system 10 to operate the pontoon boat 12, the user may then pull the cover 22 to release the tension from the spring-biased actuator 30, which then retracts and winds the cover 22 about the roller 24.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A pontoon boat including a cover system, comprising:

the pontoon boat including a superstructure;

a plurality of arcuate support bows, each of the plurality of arcuate support bows including a distal member and a proximal member;

wherein the plurality of arcuate support bows extend orthogonally relative to a longitudinal axis of the pontoon boat;

a fastener disposed on an end of the distal member of each of the plurality of arcuate support bows, the fastener configured to receive a railing of the superstructure;

a roller including a first end and a second end, the first end and the second end including a support arm, the support arm including a bracket configured to attach to the superstructure;

wherein the roller extends at least a longitudinal length of the superstructure and parallel to the longitudinal axis of the pontoon boat;

wherein the roller is configured to rotate in a first direction and a second direction;

a cover including a first end and a free second end, the first end attached to the roller, the roller configured to extend and retract the cover; and an actuator operably coupled to the roller, the actuator configured to retract the cover via rotation of the roller.

2. The cover system of claim 1, further comprising a plurality of tubular members, each of the plurality of tubular members slidably housing one of the plurality of arcuate support bows, wherein each of the plurality of arcuate support bows is configured to slidably extend and retract from the tubular member.

3. The cover system of claim 1, wherein each of the plurality of arcuate support bows comprises a plurality of elongated members slidably disposed within one another in a telescopic arrangement.

4. The cover system of claim 1, wherein the support arms are pivotally connected to the pontoon boat superstructure and movable upwardly and downwardly relative to the pontoon boat, wherein the support arms are positionable between a stowed position and a deployment position relative to the pontoon boat.

5. The cover system of claim 1, wherein the cover comprises water impermeable tarpaulin.

6. The cover system of claim 1, wherein the free second end of the cover comprises:

a plurality of fasteners disposed along an edge thereof;

a handle disposed on an edge thereof; and an elongated rod disposed along an edge thereof.

7. The cover system of claim 1, wherein the cover further comprises a first side and a second side, each of the first side and the second side having a length configured to extend over a front and a rear of the pontoon boat superstructure.

8. The cover system of claim 7, wherein the first side and second side each comprise a plurality of fasteners disposed along an edge thereof.

9. The cover system of claim 7, wherein the first side and the second side each include a flap pivotally attached to an edge thereof, the flaps being foldable relative to the cover and having a length configured to extend over the front and rear of a pontoon boat to fully enclose the superstructure thereof, wherein each flap includes a fastener.

10. The cover system of claim 7, wherein the first side of the cover comprises a transparent portion.

11. The cover system of claim 1, wherein the actuator comprises a spring-biased actuator disposed in an interior volume of the roller, the spring-biased actuator including a spring-biased towards the second direction and a ratchet operably coupled to the spring, wherein extension of the cover in the first direction increases the tension in the spring and wherein the ratchet enables a user to lock the cover when extended and release the tension in the spring.

12. The cover system of claim 1, wherein the actuator comprises a hand crank, wherein rotation of the hand crank rotates the roller in the second direction.

13. The cover system of claim 1, wherein the actuator comprises an electric motor coupled to an activation switch on a pontoon boat steering station, wherein actuation of the activation switch rotates the roller in the second direction.

14. A cover system for a pontoon boat, comprising:

a plurality of arcuate support bows including a distal member and a proximal member configured to attach to a superstructure of a pontoon boat;

a fastener disposed on an end of the distal member;

a plurality of tubular members, each of the plurality of tubular members slidably housing one of the plurality of arcuate support bows, wherein each of the plurality of arcuate support bows is configured to slidably extend and retract from the tubular member;

a roller including a first end and a second end, the first end and the second end including a support arm having a bracket for mounting the roller to the superstructure of a pontoon boat;

a tarpaulin cover including a first end and a free second end, the first end being attached to the roller and the free second end including a handle and a plurality of fasteners;

wherein the roller is configured to extend and retract the cover; and an actuator operably coupled to the roller, the actuator configured to retract the cover via rotation of the roller.

15. The cover system of claim 14, wherein the free second end of the cover further comprises an elongated rod disposed along an edge thereof.

16. The cover system of claim 14, wherein the cover further includes a first side and a second side each having a plurality of fasteners disposed along an edge thereof.

17. The cover system of claim 14, wherein the cover further includes a first side and a second side, each of the first side and the second side including a flap pivotally attached to an edge thereof, the flaps being foldable relative to the cover.

18. The cover system of claim 16, wherein the first side of the cover comprises a transparent portion.

19. The cover system of claim 14, wherein the actuator comprises a spring-biased actuator disposed in an interior volume of the roller, the spring-biased actuator including a spring-biased towards the second direction and a ratchet operably coupled to the spring.

20. The cover system of claim 14, wherein the actuator comprises a hand crank, wherein rotation of the hand crank rotates the roller.

* * * * *